US007428965B2

(12) United States Patent
Johnson et al.

(10) Patent No.: US 7,428,965 B2
(45) Date of Patent: Sep. 30, 2008

(54) SOAP BAR WRAPPER

(75) Inventors: Steve Johnson, Basking Ridge, NJ (US); Todd VanGordon, Basking Ridge, NJ (US)

(73) Assignee: Colgate-Palmolive Company, New York, NY (US)

( * ) Notice: Subject to any disclaimer, the term of this patent is extended or adjusted under 35 U.S.C. 154(b) by 733 days.

(21) Appl. No.: 10/486,890

(22) PCT Filed: Aug. 16, 2002

(86) PCT No.: PCT/US02/26135

§ 371 (c)(1),
(2), (4) Date: Feb. 11, 2004

(87) PCT Pub. No.: WO03/016168

PCT Pub. Date: Feb. 27, 2003

(65) Prior Publication Data

US 2004/0248751 A1 Dec. 9, 2004

Related U.S. Application Data

(60) Provisional application No. 60/313,119, filed on Aug. 17, 2001.

(51) Int. Cl.
*A47K 5/08* (2006.01)
*A61K 7/50* (2006.01)

(52) U.S. Cl. ..... 206/77.1; 510/141

(58) Field of Classification Search ..... 206/77.1, 206/524.1, 524.6; 510/140, 141, 439; 229/87.01, 229/87.06

See application file for complete search history.

(56) References Cited

U.S. PATENT DOCUMENTS

| | | | | |
|---|---|---|---|---|
| D345,817 | S | 4/1994 | Crawford | |
| D346,241 | S | 4/1994 | Crawford | |
| D348,539 | S | 7/1994 | Crawford | |
| D348,541 | S | 7/1994 | Crawford | |
| 6,048,829 | A * | 4/2000 | Milio et al. | 510/140 |
| 6,242,397 | B1 * | 6/2001 | Milio et al. | 510/140 |
| 6,336,553 | B1 * | 1/2002 | Gordon | 206/77.1 |
| 6,520,322 | B2 * | 2/2003 | Moss | 206/77.1 |
| 2004/0248750 | A1 * | 12/2004 | Nimmey et al. | 510/141 |

FOREIGN PATENT DOCUMENTS

| | | |
|---|---|---|
| EP | 0 602 299 A1 | 6/1994 |
| GB | 1 045 217 A | 10/1966 |

* cited by examiner

*Primary Examiner*—J. Gregory Pickett
(74) *Attorney, Agent, or Firm*—Amy M. Fernandez; Michael J Wallace, Jr.

(57) ABSTRACT

Soap bars (10) that are not of essentially a square or rectangular shape, but of a generally rectangular shape, can be packaged using a single plastic film wrapper (40). This plastic film (40) preferably is biaxially oriented polypropylene of from about 60 micron to about 180 microns. It can be a monolayer or a multilayer laminated. However, any plastic film having a Taber stiffness of more than about 5 and preferably about 7 to 20 can be used. The soap bar (10) in order to facilitate making an effective longitudinal seal on the bottom of the soap bar package should have a planar surface adjacent to the position of the overlapping longitudinal edges of the wrapping film (40). This provides a surface for the sealing plate to seal the longitudinal edges against.

10 Claims, 3 Drawing Sheets

SOAP BAR WRAPPER

This application claims the benefit of U.S. Provisional Application No. 60/313,119 filed Aug. 17, 2001.

FIELD OF THE INVENTION

This invention relates to wrappers for shaped soap bars. More particularly, this invention relates to a single plastic wrapper for a shaped generally rectangular soap bar.

BACKGROUND OF THE INVENTION

Soap bars are produced in various shapes. These range from round, to square, to rectangular to elliptical and variations on these shapes. Some soap bar shapes are easy to wrap while others present a measure of difficulty. Square, rectangular and circular shaped bars are relatively easy to package. They can be wrapped in a single relatively thin plastic film folded at the ends and heat sealed. These also can be packaged in a flow wrap. In this type of wrapper, the ends are fin sealed rather than being folded and sealed. However, elliptical shaped bars and generally rectangular shapes having curved edges and curved primary surfaces present packaging difficulties in other than flow wrap packaging. Examples of generally rectangular soap bars are shown in U.S. Des. 345,817; U.S. Des. 346,241; U.S. Des. 348,539 and U.S. Des. 348,541. These design patents are incorporated herein by reference. These have a rectangular-like shape having main top, bottom, side and end surfaces that are curved. Further, the transition of one surface to another surface is curved. The soap bars are rectangular-like but with non-planar top, bottom and front and rear connecting surfaces. The end surfaces may have a flat area for sealing but otherwise usually are curved. This includes ovoid shaped soap bars since they also have an elongated type of structure. The transition from one surface to another surface preferably also is curved. This curving gives the soap bar a pleasing, aesthetic shape. Such soap bars are described herein as generally rectangular shaped soap bars.

In order to wrap such bars so that they have a substantially rectangular shape, a stiffener reinforcing element is conventionally used to shape the package. The stiffener reinforcing element is a piece of relatively stiff material such as paperboard, paperboard coated with plastic or plastic that is wrapped laterally around the soap bar with the ends of the soap bar being open. Then, the soap bar and the stiffener reinforcing element are surrounded by a wrapper which is folded at its ends and the flaps of the folds heat sealed, one to the other. There also is a longitudinal seal of the film on the bottom surface of the package. A problem in the use of a stiffener reinforcing element is that it requires the handling and use of two films. The stiffener reinforcing element film and the wrapper film. The packaging process and cost can be reduced with the use of only one film, the wrapper film. That is, the stiffener reinforcing element films is deleted. It has been found that this can be done if a particular wrapper film is used. This film will be sufficiently stiff to provide a rectangular shape to the packaged soap bar, but yet be able to be readily folded and sealed to produce the package.

BRIEF DESCRIPTION OF THE INVENTION

It has been found that a reinforcing element stiffener is not required if a plastic wrapper of about 60 micron to about 180 micron is used, and preferably about 90 micron to about 150 micron. This plastic can be of a monolayer or laminate multilayer construction. Such a plastic has a sufficient thickness to form and maintain a generally rectangular shape, but yet a thickness where the film can be folded to form the end side panels without the need for optional fold enhancement techniques. Preferably, it will be a thermoplastic film or thermoplastic coated paper or paperboard to aid in the sealing of the film. In such a wrapping of soap bars, there also is a longitudinal lap seal on the lower surface of the package with the end seals having folds and the folds sealed. These usually are heat seals since thermoplastic films are used. An adhesive can be used to form such heat seals in conjunction with the thermoplastic film.

The films of this invention have a Taber stiffness of more than about 5 to form the package and are sufficiently flexible so that end panels can be formed and sealed. Preferably the Taber stiffness is about 8 to 20. A preferred film is biaxially oriented polypropylene. This can be a monolayer or a multilayer of two or more layers. However, any other sealable plastic surface films having similar Taber stiffness can be used. These usually will have a thickness in the 60 micron to 180 micron range. However, it is the stiffness that primarily will control use. The films should have a Taber stiffness of about 7 to 20 which is equivalent to that of about 60 micron to about 180 micron biaxially oriented polypropylene film.

In order to form a more effective bottom longitudinal overlapping seal on the soap bar package the soap bar should have a planar area on its bottom surface. The bottom surface can have curved surfaces and sections but at least one area should be planar. Further this planar area should be adjacent to the area where the bottom overlapping seal is to be made. That is, the overlapping edges of the film should be adjacent to the planar area of the bottom of the soap bar. The seal plate or band will hold the overlapping film edges against the planar area of the bottom surface of the soap bar to effect the bottom seal of the soap bar package.

DETAILED DESCRIPTION OF THE INVENTION

The present invention although useful with many objects will be described with regard to a soap package that does not require a stiffener to wrap generally rectangular soap bars and will be set out in more detail with reference to the preferred embodiments. A generally rectangular soap bar is one described above that has an elongated rectangular-like shape inclusive of an ovoid shape, with main surfaces that are curved and preferably curved in the transition from one main surface to another. Examples are shown in the above U.S. Design Patents which have been incorporated herein by reference. It is an aesthetically pleasing shaped soap bar and one that is relatively easy to grip and to use. However, it is difficult to package in other than a carton, flow wrap, or two component package that requires both a stiffener sheet laterally around the soap bar and a wrapper that fully encloses the soap bar.

It has been found that a one piece package can be used to package soap bars and other objects that are generally rectangular in shape. A single plastic or plastic coated paper or paperboard film having a thickness of about 60 microns to about 180 microns, and preferably about 90 microns to about 150 microns, a Taber Stiffness of more than about 5, and preferably about 7 to about 20 m can be used. This is an average Taber Stiffness for both directions. This film is sufficiently stiff to form a rectangular-like package for the soap bar or other object. This film can be plastic, paper or paperboard with or without a plastic coating and can be opaque, translucent or transparent. Further it can be colored or tinted and/or printed with a decoration and/or information about the product.

Figure 1:
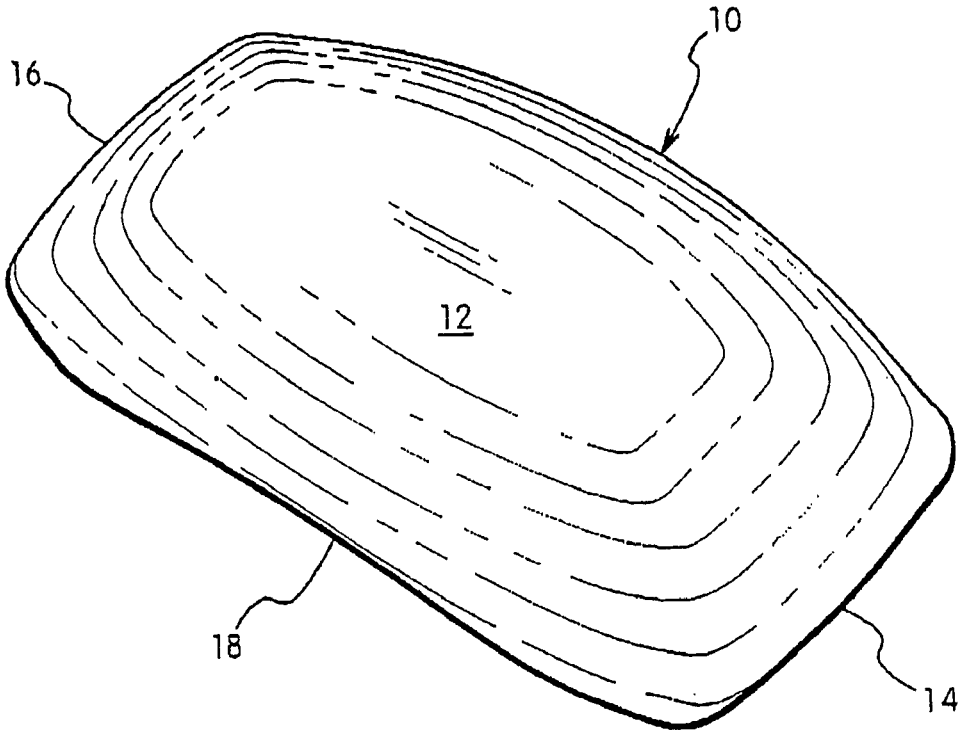
FIG. 1 is a perspective view of a of a generally rectangular soap bar.
Figure 2:
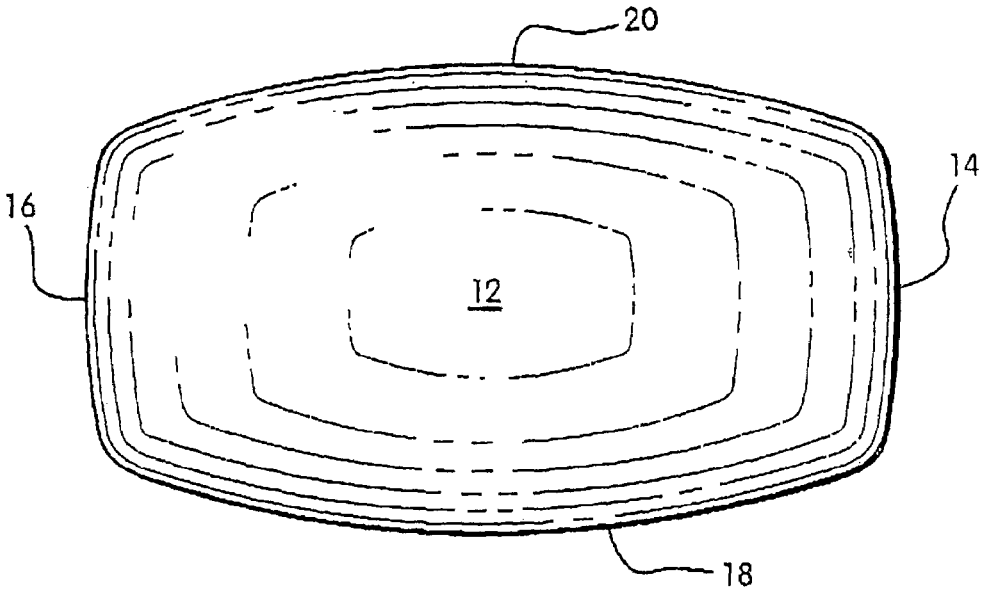
FIG. 2 is a top plan view of the soap bar of FIG. 1.
Figure 3:
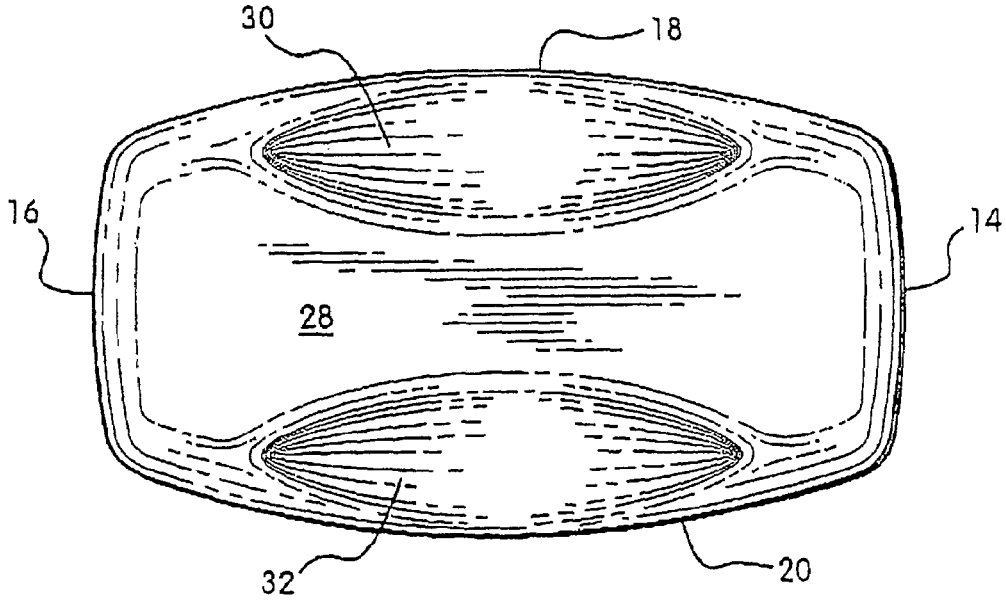
FIG. 3 is a bottom plan view of the soap bar of FIG. 1.

FIG. 1 is a depiction of an embodiment of a generally rectangular soap bar 10. It has a compound curved top surface 12, a left end surface 16, a right end surface 14 and a front surface 18. This soap bar is further depicted in FIGS. 2 and 3. FIG. 2 is a top plan view with this view also showing the compound curve of the top surface of the soap bar. Also shown in this view is side 20. FIG. 3 is a bottom plan view of the soap bar. This shows side surfaces 18 and 20 and end surfaces 14 and 16. Each of these is shown to have a compound curvature. Further side surface 18 and 20 have scalloped, dished out areas 30 and 32. These scalloped areas extend into bottom surface 28. The bottom surface 28 except for the scalloped areas 30 and 32 is planar. It is this planar area of the bottom surface which will assist in the forming of the longitudinal seal on the film that is used to form the seal on the longitudinal edges that are overlapped on the bottom surface in the packaging of soap bars. It is conventional to have a seal longitudinally across the bottom of a soap bar package. At the soap bar ends, the film is folded and sealed. The seals are made by heat sealing the film material to itself, or by activating an adhesive on the surface of the film. Both are conventional techniques for sealing films and are used in making seals on soap bar packages.

Figure 4:
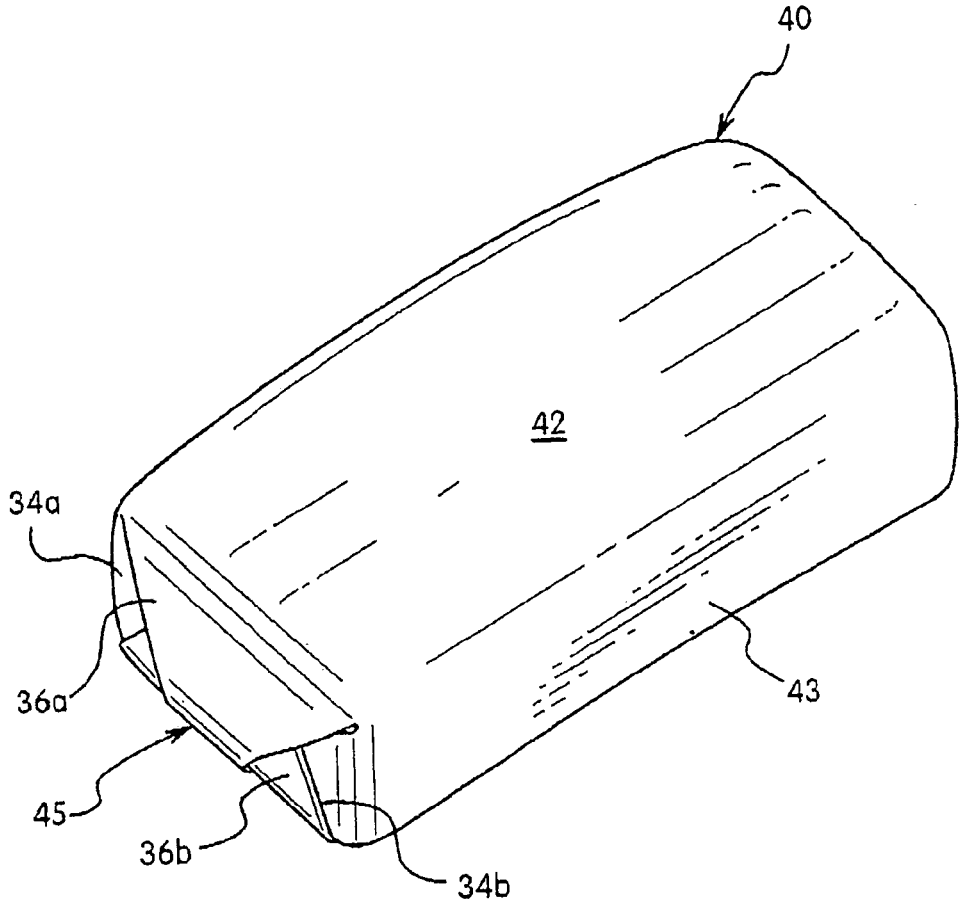
FIG. 4 is a perspective view of the packaged soap bar of FIG. 1.

FIG. 4 shows the soap bar of FIG. 1 that is packaged in a 104 micron biaxially oriented polypropylene film. The soap bar 10 is packaged within the wrapper 40. The wrapper has a top has a top surface 42, longitudinal side surface 43 and end surface 45. The end surface has fold over seals formed by folded sections 34(*a*) and 34(*b*) that are overlayed by folded sections 36(*a*) and 36(*b*). Longitudinally across the bottom of the package is a seal of the overlapping edges of the film that is folded over on the bottom. The side folds and seals and the bottom seals are conventional in wrapping soap bars.

As noted above, the film for the package can be comprised of paper, paperboard or plastics, including combinations of these materials. This includes plastic/plastic laminates, plastic/paper laminates, plastic/paper/plastic laminates, plastic/paperboard laminates and plastic/paperboard plastic laminates. The useful plastics are primarily thermoplastics and include polyethylenes, polypropylenes, ethylene-propylene copolymers, polyesters such as polyethylene terephthalate, polyvinyl chloride, polyvinyl acetate, polyvinyl alcohol, ethylene vinyl compound copolymers, polystyrenes, and acrylnitrile-butadiene styrene copolymers. Economics dictate the preferred us of thermoplastics such as polyethylenes and polypropylenes, and more preferably biaxially oriented polypropylene. The films are formed by conventional and known processes.

We claim:

1. A wrapped soap bar comprising a generally rectangular soap bar wrapped laterally with a film having a thickness of about 60 micron to about 180 micron and a Taber Stiffness of more than about 5, the longitudinal ends of said soap bar enclosed by a folded over edge portion of said film, said soap bar having a longitudinal planar area on a lower surface adjacent to an overlap of end edges of said film that are sealed to form said, wrapped soap bar, the wrapped soap bar being devoid of a stiffener reinforcing element.

2. A wrapped soap bar as in claim 1 which said thickness is about 90 micron to a about 150 micron and a Taber Stiffness of about 7 to 20.

3. A wrapped soap bar as in claim 1 wherein said film is a biaxially oriented thermoplastic film.

4. A wrapped soap bar as in claim 1 wherein said film is selected from the group consisting of polyethylenes, polypropylenes, vinyl polymers, acrylic polymers and copolymers, styrene polymers and copolymers and polyesters.

5. A wrapped soap bar as in claim 4 wherein the film is polyethylene.

6. A wrapper soap bar as in claim 4 wherein said thermoplastic film is polypropylene.

7. A wrapper soap bar as in claim 4 wherein said thermoplastic film is biaxially oriented polypropylene.

8. A wrapped soap bar as in claim 1 wherein said thermoplastic film is polyvinyl chloride.

9. A wrapped soap bar as in claim 1 wherein said thermoplastic film is polyethylene terephthalate.

10. A wrapped soap bar as in claim 1 wherein said folded over end portions of said film are sealed.

* * * * *